US008376709B2

(12) United States Patent
Yoo et al.

(10) Patent No.: US 8,376,709 B2
(45) Date of Patent: Feb. 19, 2013

(54) IMPELLER OF A SUCTION-ENFORCED TYPE AND FAN-MOTOR HAVING THE SAME

(75) Inventors: Myung-Keun Yoo, Seoul (KR); Jun-Young Lim, Incheon (KR)

(73) Assignee: LG Electronics Inc., Seoul (KR)

( * ) Notice: Subject to any disclaimer, the term of this patent is extended or adjusted under 35 U.S.C. 154(b) by 552 days.

(21) Appl. No.: 12/446,033

(22) PCT Filed: Oct. 20, 2006

(86) PCT No.: PCT/KR2006/004287

§ 371 (c)(1),
(2), (4) Date: Apr. 17, 2009

(87) PCT Pub. No.: WO2008/047964

PCT Pub. Date: Apr. 24, 2008

(65) Prior Publication Data

US 2010/0322773 A1 Dec. 23, 2010

(51) Int. Cl.
*F01D 5/22* (2006.01)

(52) U.S. Cl. ..... 416/186 R; 415/64; 416/175

(58) Field of Classification Search ..... 415/64, 415/143, 63; 416/213 R, 213 A, 214 R, 185, 416/182, 124, 126, 175
See application file for complete search history.

(56) References Cited

U.S. PATENT DOCUMENTS

| | | | | |
|---|---|---|---|---|
| 4,167,369 A * | 9/1979 | Ishihara | ..... | 416/185 |
| 6,592,329 B1 * | 7/2003 | Hirose et al. | ..... | 416/203 |

FOREIGN PATENT DOCUMENTS

| | | | | |
|---|---|---|---|---|
| JP | 59103999 | * | 6/1984 | ..... 416/183 |
| JP | 59-190497 | A | 10/1984 | |
| JP | 3-138493 | A | 6/1991 | |
| JP | 03138493 | * | 6/1991 | ..... 416/243 |
| JP | 05010294 | * | 1/1993 | ..... 415/148 |
| JP | 08-193598 | * | 7/1996 | |
| JP | 2000-136795 | A | 5/2000 | |
| JP | 2005-214057 | A | 8/2005 | |
| KR | 10-2001-0043570 | A | 5/2001 | |

OTHER PUBLICATIONS

Yamaoka et al , English Abstract for JP59-103999, (Jun. 1984), 1 page.*
Shimizu, et al , English Abstact for JP 03-138493 (Jun. 1991), 1 page.*
Kato, English Abstract for JP 05-010294, (Jan. 1993), 1 page.*
Kayama (JP 08-193598) (1996) Translation , 9 pages.*

* cited by examiner

*Primary Examiner* — Caridad Everhart
(74) *Attorney, Agent, or Firm* — Birch, Stewart, Kolasch & Birch, LLP

(57) ABSTRACT

Disclosed are an impeller of a suction-enforced type, and a fan-motor for a vacuum cleaner having the same. The fan-motor having the impeller of the suction-enforced type includes: a motor housing; a motor installed in the motor housing; an impeller casing coupled to the upper portion of the motor housing; the impeller of the suction-enforced type installed in the impeller casing and connected to a rotation shaft of the motor; and a guide vane installed at the lower portion of the impeller of the suction-enforced type, for guiding the air sucked into the impeller casing to the motor side. As a result, suction efficiency of the impeller is improved, and thus efficiency of the fan-motor for the vacuum cleaner is improved.

2 Claims, 5 Drawing Sheets

IMPELLER OF A SUCTION-ENFORCED TYPE AND FAN-MOTOR HAVING THE SAME

TECHNICAL FIELD

The present invention relates to a fan-motor for a vacuum cleaner, and more particularly, to an impeller of a suction-enforced type which is reduced in size and improved in suction force, and a fan-motor for a vacuum cleaner having the same.

BACKGROUND ART

FIG. 1 is a vertical-sectional view illustrating a conventional fan-motor for a vacuum cleaner. Referring to FIG. 1, in the conventional fan-motor for the vacuum cleaner, a motor 4 composed of a stator 2 and a rotor 3 is installed in a motor housing 1 having its upper portion opened, and a rotation shaft 5 is fit-pressed into the center portion of the rotor 3 in the up/down direction, and rotated with the rotor 3, for transmitting power.

An opening unit of an impeller casing 6 having a suction hole 6*a* on its top surface is coupled to the upper opening unit of the motor housing 1. An impeller 7 coupled to the top end of the rotation shaft 5 for sucking the air through the suction hole 6*a* is installed inside the impeller casing 6. A guide vane 8 for guiding the air sucked into the impeller casing 6 by the impeller 7 to the motor side 4 is installed at the lower portion of the impeller 7.

The guide vane 8 includes a body unit 9 formed in a circular planar shape with a predetermined thickness and area, a plurality of diffuser vanes 10 installed on the edges of the top surface of the body unit 9 at regular intervals, for raising a pressure of the air passing through the impeller 7, and a plurality of return vanes 11 installed on the bottom surface of the body unit 9, for guiding the air pressure-raised by the diffuser vanes 10 to the motor side 4.

In the conventional fan-motor for the vacuum cleaner, when power is applied to the motor 4, rotation force is generated in the rotor 3, for rotating the rotor 3. The rotation shaft 5 is rotated with the rotor 3.

When the rotation shaft 5 is rotated, the impeller 7 coupled to the top end of the rotation shaft 5 is rotated, to generate suction force. By the suction force, the air is sucked into the impeller casing 6 through the suction hole 6*a* of the impeller casing 6. The sucked air passes through the impeller 7, and is discharged to the lateral direction of the impeller 7.

The pressure of the air passing through the impeller 7 is raised by the diffuser vanes 10 of the guide vane 8. The air having the raised pressure is supplied to the lower side return vanes 11 through space units 12 between the inner circumference of the impeller casing 6 and the outer circumference of the guide vane 8, guided to the center portion by the return vanes 11, and sent to the motor side 4. Accordingly, the motor 4 is cooled and the air is discharged.

The impeller 7 and the flow of the sucked air passing through the impeller 7 will now be explained with reference to FIGS. 2 and 3.

FIG. 2 is a perspective view illustrating a general 2-dimensional (2D) impeller, and FIG. 3 is a partial cross-sectional view provided to explain a flow passing through the impeller of FIG. 2.

As illustrated in FIG. 2, the impeller 7 includes a top plate 7*a* having a suction hole 7*a*' at its center portion to communicate with an impeller casing 6 to suck the air, a bottom plate 7*b* being disposed to overlap with the top plate 7*a*, and having a shaft hole 7*b*' at its center portion so that a rotation shaft 5 can be inserted into the shaft hole 7*b*', and a plurality of blades 7*c* disposed between the top plate 7*a* and the bottom plate 7*b*, isolated from each other in the circumferential direction at regular intervals, and extended in the radial direction. Since the impeller 7 induces a 2D flow, it is called the 2D impeller.

As shown in FIG. 3, in a fan-motor for a vacuum cleaner using the 2D impeller 7, the air flow sucked into the suction hole 7*a*' of the top plate 7*a* through a suction hole 6*a* (refer to FIG. 1) of the impeller casing 6 is not smoothly transferred to the blade sides 7*c* due to weak induction in the suction hole 7*a*'. That is, a suction flow loss occurs in the suction hole side 7*a*'.

In general, if a fluid flow undergoes a direction change or a sudden shape change, a flow loss is caused by a change degree. In the case of the 2D impeller 7, the sucked flow is bent at an angle of almost 90° and sent to gaps between the blades 7*c* (refer to arrows).

A 3D impeller generally known to be suitable for high speed rotation (over 70,000 rpm) can be used to overcome the flow loss by inducing a 3D flow. It will be explained below with reference to FIG. 4.

FIG. 4 is a perspective view illustrating a general 3D impeller, and FIG. 5 is a partial cross-sectional view provided to explain a flow passing through the impeller of FIG. 4.

As depicted in FIG. 4, the 3D impeller 7' includes a main body 7'*a* having a shaft hole 7'*c* into which a rotation shaft 5 is coupled, and a plurality of blades 7'*b* arranged along the outer circumference of the main body 7'*a* having predetermined curvature, and isolated from each other with their upper portions bent.

As shown in FIG. 5, in the 3D impeller 7' applied to a fan-motor for a vacuum cleaner, the inducer unit formed by bending the upper portions of the blades 7'*b* straightens a sucked fluid and pushes the fluid to a target direction, namely, to diffuser vane sides 10 disposed to surround the impeller 7'. This configuration reduces a flow loss in a suction hole side 6'*a* of an impeller casing 6' and facilitates a flow to the diffuser vane sides 10.

However, as illustrated in the above drawings, the 3D impeller 7' is higher than the 2D impeller 7, thereby increasing the size of the impeller casing 6'. As a result, the size of the fan-motor for the vacuum cleaner increases, and the whole size of the vacuum cleaner increases.

DISCLOSURE OF THE INVENTION

Therefore, an object of the present invention is to provide an impeller of a suction-enforced type which is reduced in size and improved in suction force.

Another object of the present invention is to provide a fan-motor for a vacuum cleaner having the impeller of the suction-enforced type.

To achieve these and other advantages and in accordance with the purpose of the present invention, as embodied and broadly described herein, there is provided an impeller of a suction-enforced type, including: a 2D impeller; and a 3D impeller installed at the center portion of the 2D impeller.

There is also provided an impeller of a suction-enforced type, including: a top plate having a suction hole at its center portion; a bottom plate being isolated from the lower portion of the top plate at a predetermined interval, and having a shaft hole at its center portion so that a rotation shaft can be coupled into the shaft hole; a plurality of blades for coupling the top plate to the bottom plate between the top plate and the bottom plate, the blades being arranged along the circumferential direction at regular intervals and extended in the radial direction; and an inducer unit formed at the center portion of the bottom plate, for inducing a suction flow from the suction hole of the top plate to the blades.

Preferably, the inducer unit is a 3D impeller disposed in a space limited by the inside ends of the blades.

Preferably, the inducer unit is formed by bending the inside top ends of the blades to one direction.

In addition, there is provided a fan-motor having an impeller of a suction-enforced type, including: a motor housing; a motor installed in the motor housing; an impeller casing coupled to the upper portion of the motor housing; the impeller of the suction-enforced type installed in the impeller casing and connected to a rotation shaft of the motor; and a guide vane installed at the lower portion of the impeller of the suction-enforced type, for guiding the air sucked into the impeller casing to the motor side.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODES FOR CARRYING OUT THE PREFERRED EMBODIMENTS

Reference will now be made in detail to the preferred embodiments of the present invention, examples of which are illustrated in the accompanying drawings.

Hereinafter, an impeller of a suction-enforced type and a fan-motor having the same according to the present invention will be explained in more detail with reference to the attached drawings.

Figure 6:
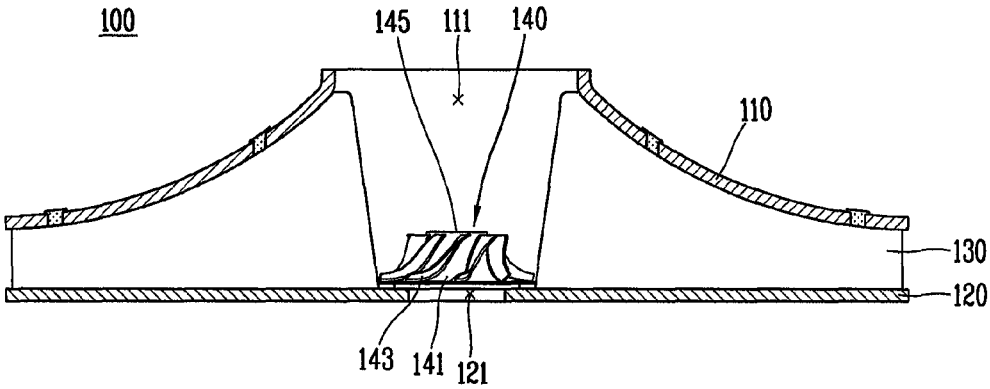
FIG. 6 is a perspective view illustrating an impeller of a suction-enforced type in accordance with one preferred embodiment of the present invention.
Figure 7:
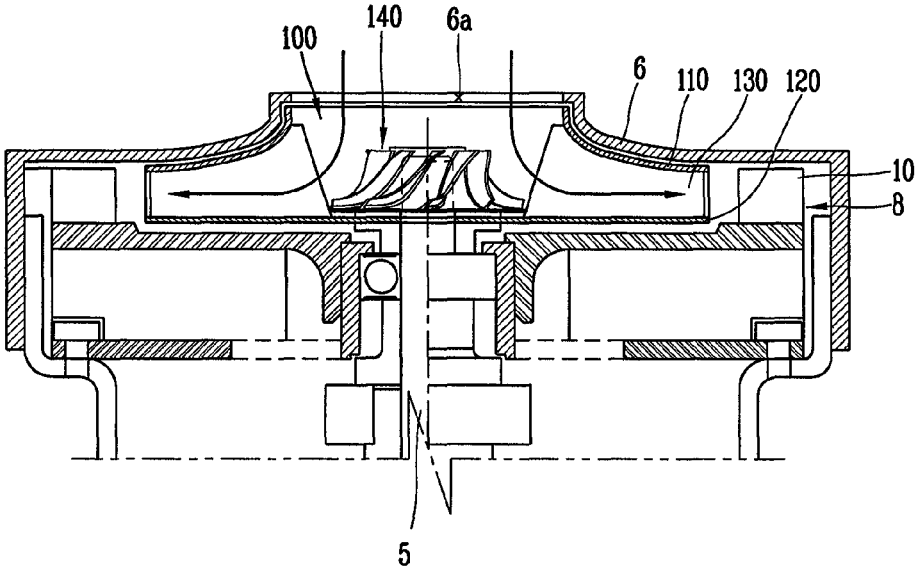
FIG. 7 is a partial cross-sectional view provided to explain a flow passing through the impeller of FIG. 6 in a fan-motor using the impeller.

FIG. 6 is a perspective view illustrating an impeller of a suction-enforced type in accordance with one preferred embodiment of the present invention, and FIG. 7 is a partial cross-sectional view provided to explain a flow passing through the impeller of FIG. 6 in a fan-motor using the impeller.

Referring to FIG. 6, the impeller 100 includes a top plate 110, a bottom plate 120, blades 130 and an inducer unit 140.

The top plate 110 has a suction hole 111 at its center portion. The upper portion of the top plate 110 is bent so that the center portion of the top plate 110 can be higher than the outer portion thereof. When the impeller 100 is rotated by driving a motor 4, the outdoor air is sucked through the suction hole 111 communicating with a suction hole **6*a* of an impeller casing 6**.

The bottom plate 120 is formed in a disk shape, and isolated from the lower portion of the top plate 110 at a predetermined interval. The bottom plate 120 has a shaft hole 121 at its center portion so that a rotation shaft 5 can be inserted into the shaft hole 121.

The plurality of blades 130 are arranged between the top plate 110 and the bottom plate 120. The height of each blade 130 is reduced from the center portion of the impeller 100 to the outer portion thereof. The blades 130 are closely coupled to the top plate 110 and the bottom plate 120. The blades 130 disposed between the top plate 110 and the bottom plate 120 are isolated from each other in the circumferential direction at regular intervals, and extended in the radial direction.

The inducer unit 140 is disposed in a space limited by the inside ends of the blades 130. Here, the inducer unit 140 is a 3D impeller.

As explained above, the 3D impeller 140 used as the inducer unit includes a main body 141, and blades 143 formed along the outer circumference of the main body 141 in the up/down direction. A shaft hole 145 into which the rotation shaft 5 is inserted is formed at the center portion of the main body 141.

As illustrated in FIG. 7, when the impeller 100 having the above configuration is applied to a fan-motor for a vacuum cleaner, the air sucked through the suction hole **6*a* of the impeller casing 6 is induced to the blade sides 130 by the inducer unit 140 without being bent at an angle of 90°. Therefore, the air can smoothly flow toward the blades 130 without a large flow loss. Since the inducer unit 140 is installed in the space limited by the inside ends of the blades 130, the size of the impeller 100** does not increase.

The operation effect of the fan-motor for the vacuum cleaner using the impeller 100 will now be described in detail with reference to FIG. 8.

Figure 1:
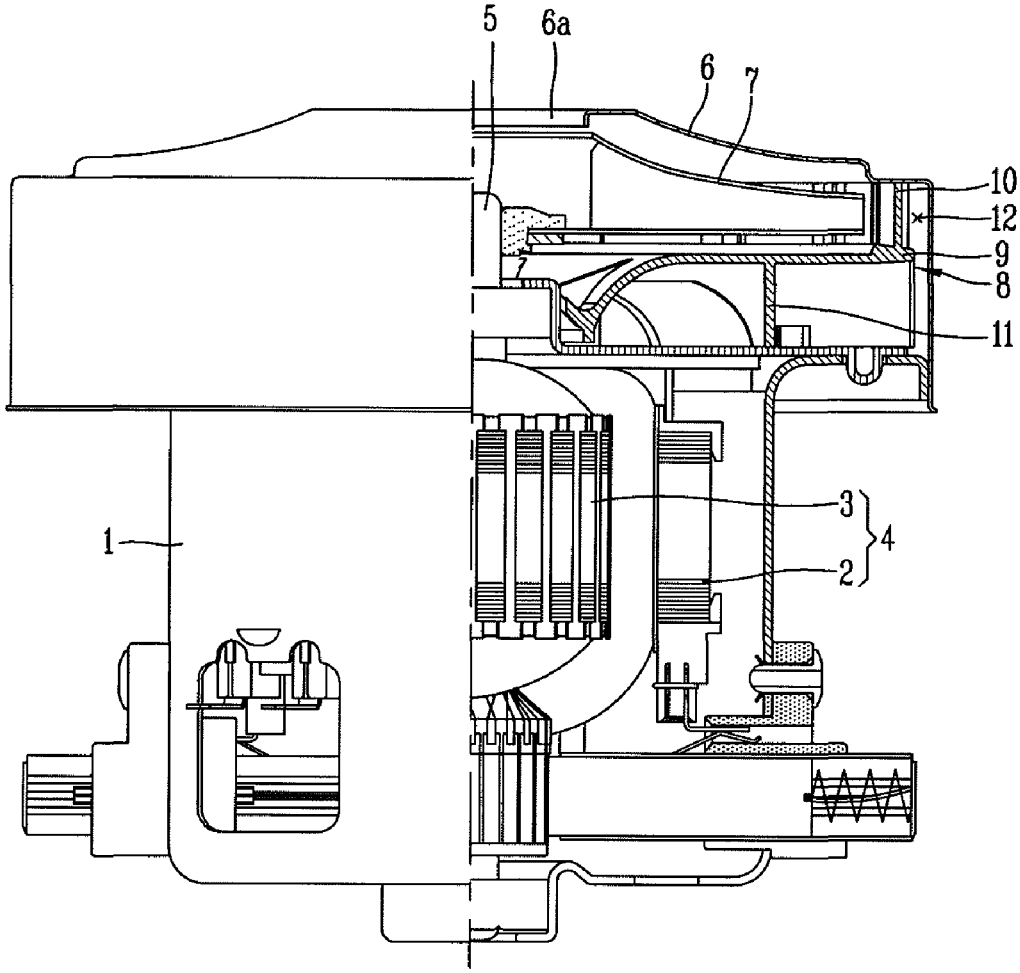
FIG. 1 PRIOR ART
FIG. 1 is a vertical-sectional view illustrating a conventional fan-motor for a vacuum cleaner.
Figure 2:
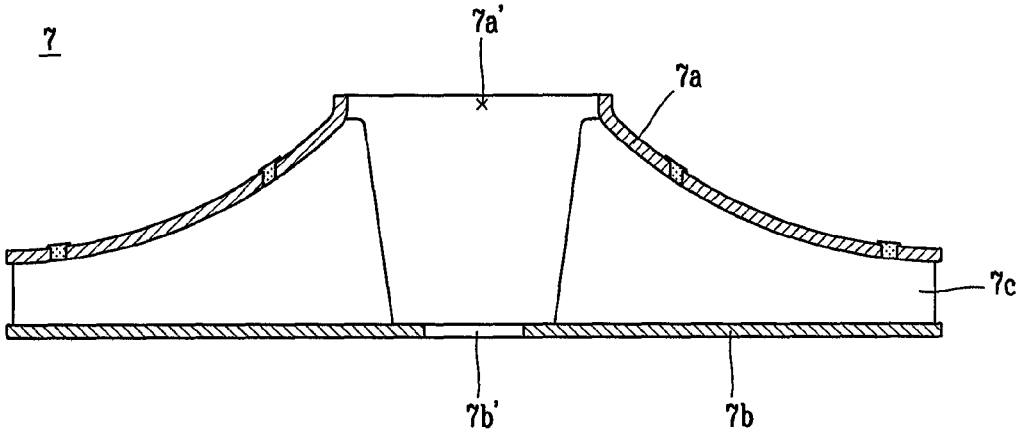
FIG. 2 is a perspective view illustrating a general 2D impeller.
Figure 3:
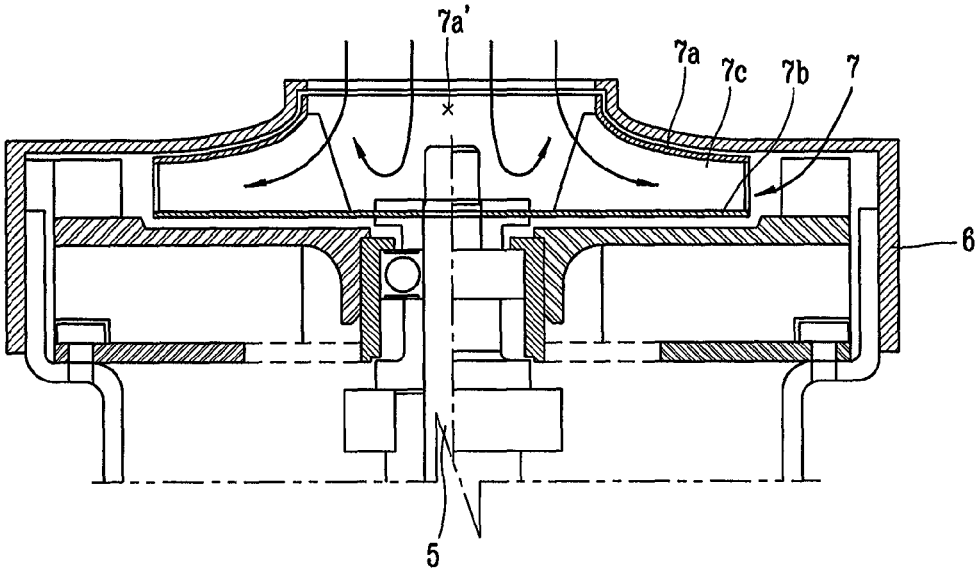
FIG. 3 is a partial cross-sectional view provided to explain a flow passing through the impeller of FIG. 2.
Figure 4:
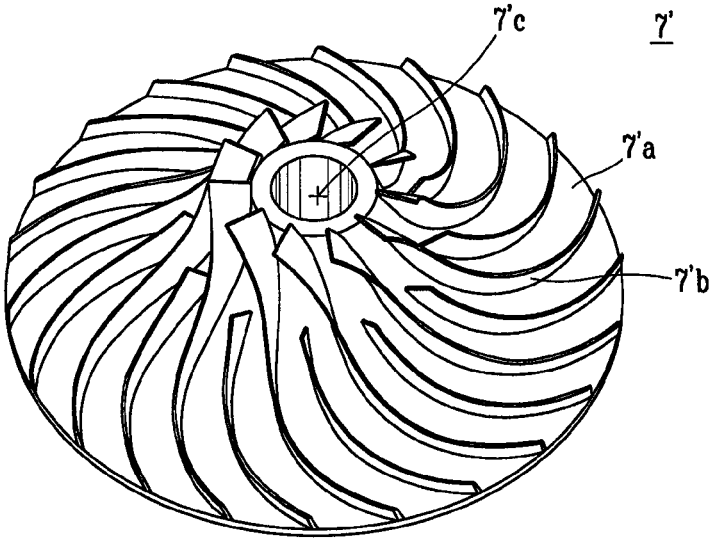
FIG. 4 is a perspective view illustrating a general 3D impeller.
Figure 5:
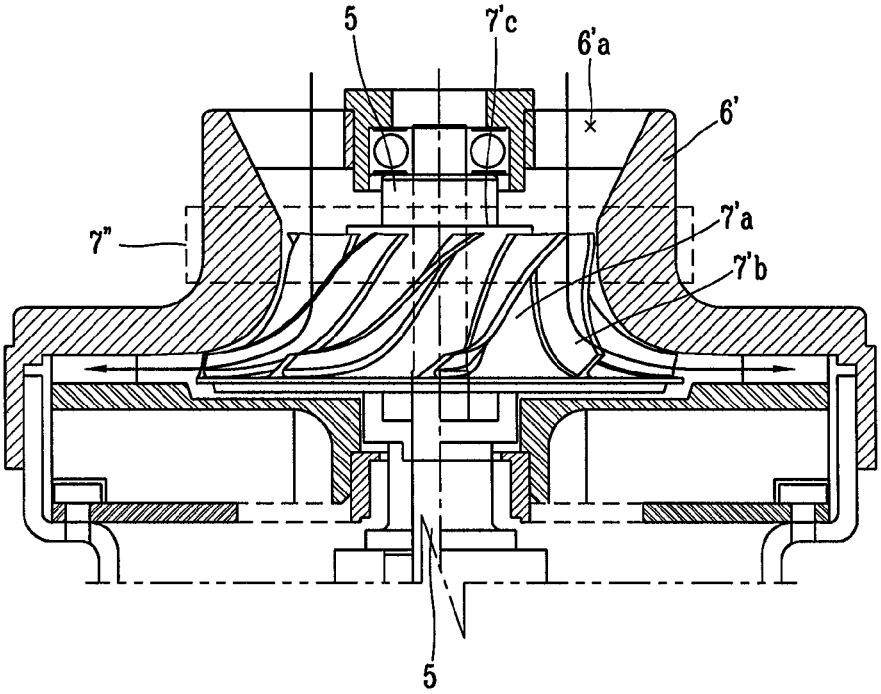
FIG. 5 is a partial cross-sectional view provided to explain a flow passing through the impeller of FIG. 4.
Figure 8:
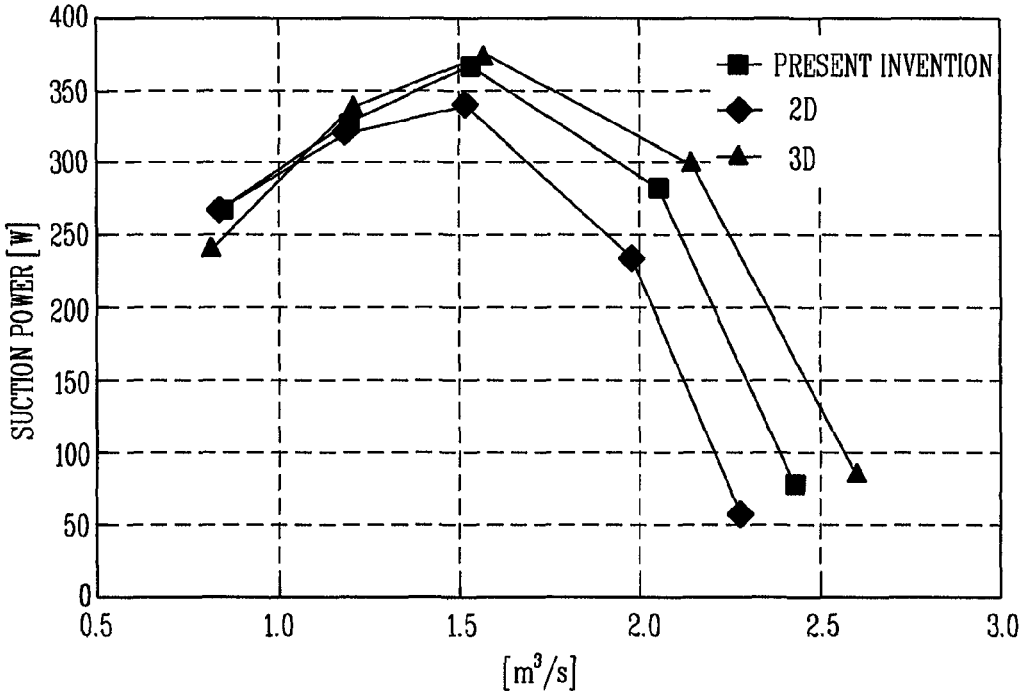
FIG. 8 is a graph showing suction power of the fan-motors using the impellers of FIGS. 2, 4 and 6.

FIG. 8 is a graph showing suction power of the fan-motors using the impellers of FIGS. 2, 4 and 6.

As shown in FIG. 8, the conventional 3D impeller 7' (refer to FIG. 4) shows the highest suction power, and the conventional 2D impeller 7 (refer to FIG. 2) shows the lowest suction power. As a flux Q increases, suction power differences increase. When the flux Q is about 1.5 $m^3/s$, each suction power W has the maximum value and decreases before/after the maximum value.

On the other hand, the impeller 100 of the present invention has higher suction power than the 2D impeller, and slightly lower suction power than the 3D impeller.

Figure 9:
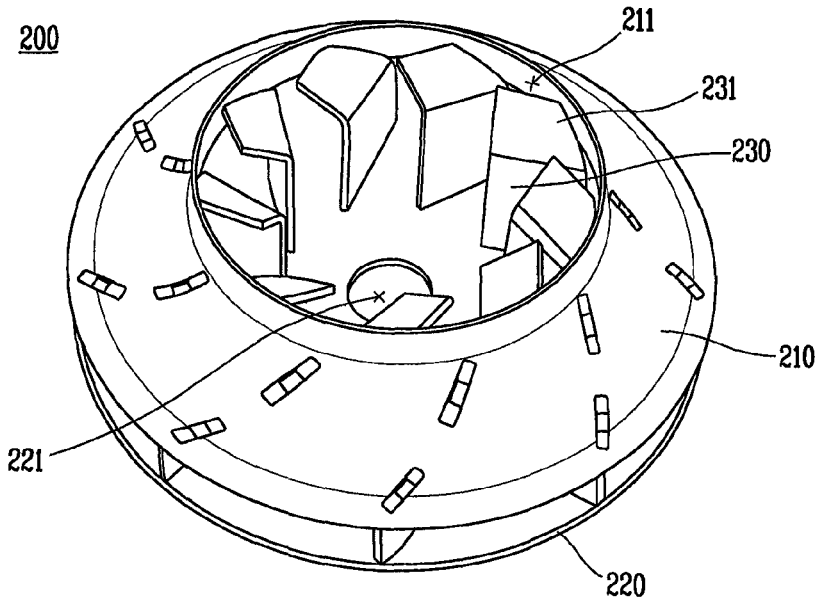
FIG. 9 is a perspective view illustrating an impeller of a suction-enforced type in accordance with another preferred embodiment of the present invention.

Another example of forming the inducer unit will now be described with reference to FIG. 9. FIG. 9 is a perspective view illustrating an impeller of a suction-enforced type in accordance with another preferred embodiment of the present invention.

Referring to FIG. 9, the impeller 200 includes a top plate 210 having a suction hole 211, a bottom plate 220 having a shaft hole 221, a plurality of blades 230 arranged between the top plate 210 and the bottom plate 220, for inducing the radial air flow, and an inducer unit 231.

The inducer unit 231 is formed by bending the inside top ends of the blades 230 to one direction.

In this configuration, the inducer unit 231 for reducing a flow loss below a predetermined level can be formed merely by bending the inside top ends of the blades 230 without adding a special component as in the above embodiment.

In accordance with the present invention, the fan-motor for the vacuum cleaner uses one of the impellers 100 and 200 of the suction-enforced type. The operation of the fan-motor for the vacuum cleaner using the impeller 100 of the suction-enforced type including the 3D impeller as the inducer unit will now be described.

As shown in FIGS. 6 and 7, when the impeller 100 is rotated by the rotation shaft 5, the air is sucked to the center portion of the impeller 100 through the impeller casing 6.

The 3D impeller is installed as the inducer unit 140 at the center portion of the impeller 100, so that the sucked air can be smoothly induced to the blades 130 by the inducer unit 140 without being bent at an angle of 90°. As a result, the flow loss is reduced at the center portion of the impeller 100, thereby improving suction efficiency of the fan-motor.

A female screw thread is formed on the inner circumference of the shaft hole 145 of the inducer unit 140 of the impeller 100. In a state where the impeller 100 is disposed, the female screw thread is directly fastened to a male screw thread of the rotation shaft 5. That is, the inducer unit 140 serves as a nut. Accordingly, when only the impeller 100 is fastened to the rotation shaft 5, any nut is not needed.

As discussed earlier, in accordance with the present invention, in the impeller of the suction-enforced type and the fan-motor for the vacuum cleaner having the same, the inducer unit for smoothly inducing the suction flow to the gaps between the blades is disposed at the suction hole side of the impeller generating the flow loss. As a result, suction efficiency of the impeller is improved, and thus efficiency of the fan-motor for the vacuum cleaner is improved.

In addition, when the 3D impeller is used as the inducer unit, the 3D impeller itself serves as a nut. Therefore, the impeller can be fastened to the rotation shaft without using a special nut. That is, the number of the components is reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. An impeller of a suction-enforced type, comprising:

a top plate having a suction hole at its center portion;

a bottom plate being isolated from the lower portion of the top plate at a predetermined interval, and having a shaft hole at its center portion so that a rotation shaft can be coupled into the shaft hole;

a plurality of blades for coupling the top plate to the bottom plate between the top plate and the bottom plate, the blades being arranged along the circumferential direction at regular intervals and extended in the radial direction; and an inducer unit formed at the center portion of the bottom plate, for inducing a suction flow from the suction hole of the top plate to the blades, wherein the inducer unit includes a vertical blade and a bent blade bent horizontally from the top of the vertical blade, wherein the vertical blade is an inner end portion of one of the plurality of blades that extends from the bottom plate towards the suction hole, and wherein a radially inner end of the vertical blade is spaced apart from the shaft hole.

2. A fan-motor for a vacuum cleaner, comprising:

a motor housing;

a motor installed in the motor housing;

an impeller casing coupled to the upper portion of the motor housing;

an impeller of a suction-enforced type installed in the impeller casing and connected to a rotation shaft of the motor; and a guide vane installed at the lower portion of the impeller of the suction-enforced type, for guiding the air sucked into the impeller casing to the motor side, wherein the impeller of the suction-enforced type includes:

a top plate having a suction hole at its center portion;

a bottom plate being isolated from the lower portion of the top plate at a predetermined interval, and having a shaft hole at its center portion so that the rotation shaft can be coupled into the shaft hole;

a plurality of blades for coupling the top plate to the bottom plate between the top plate and the bottom plate, the blades being arranged along the circumferential direction at regular intervals and extended in the radial direction; and an inducer unit formed at the center portion of the bottom plate, for inducing a suction flow from the suction hole of the top plate to the blades, wherein the inducer unit includes a vertical blade and a bent blade bent horizontally from the top of the vertical blade, wherein the vertical blade is an inner end portion of one of the plurality of blades that extends from the bottom plate towards the suction hole, and wherein a radially inner end of the vertical blade is spaced apart from the shaft hole.

* * * * *